US007737903B1

(12) United States Patent
Rao et al.

(10) Patent No.: US 7,737,903 B1
(45) Date of Patent: Jun. 15, 2010

(54) STEPPED-REFLECTOR ANTENNA FOR SATELLITE COMMUNICATION PAYLOADS

(75) Inventors: Sudhakar K. Rao, Churchville, PA (US); Minh Tang, Yardley, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 677 days.

(21) Appl. No.: 11/365,487

(22) Filed: Mar. 2, 2006

Related U.S. Application Data

(60) Provisional application No. 60/693,832, filed on Jun. 27, 2005.

(51) Int. Cl.
*H01Q 13/00* (2006.01)

(52) U.S. Cl. ..... 343/786; 343/753; 343/840; 343/909

(58) Field of Classification Search ..... 343/753, 343/786, 781, 840, 910, 914, 912, 772, 776, 343/909
See application file for complete search history.

(56) References Cited

U.S. PATENT DOCUMENTS

| | | | | |
|---|---|---|---|---|
| 4,467,329 | A * | 8/1984 | Thal, Jr. | 343/753 |
| 4,792,814 | A | 12/1988 | Ebisui | |
| 4,804,970 | A * | 2/1989 | Todd | 343/753 |
| 4,825,223 | A * | 4/1989 | Moore | 343/840 |
| 5,512,913 | A * | 4/1996 | Staney | 343/781 P |
| 5,959,590 | A * | 9/1999 | Sanford et al. | 343/781 CA |
| 6,169,524 | B1 * | 1/2001 | Wu et al. | 343/910 |
| 6,281,852 | B1 * | 8/2001 | Amarillas | 343/725 |
| 6,313,802 | B1 * | 11/2001 | Petersson | 343/753 |

(Continued)

FOREIGN PATENT DOCUMENTS

CA 2091730 A1 9/1993

(Continued)

OTHER PUBLICATIONS

Thielen, "Stepped Reflector Antenna with a Sector Shaped Main Beam", Agard Conference Proceedings, Nov. 26, 1973, pp. 43/1 through 43/15, Neuilly Sur Seine, France.

*Primary Examiner*—Douglas W Owens
*Assistant Examiner*—Chuc D Tran
(74) *Attorney, Agent, or Firm*—McDermott Will & Emery LLP

(57) ABSTRACT

A stepped reflector for being illuminated by at least one multiple-band feed is provided. The reflector includes a central region and a first annular region with an annular width of w. The first annular region is axially stepped a height h above the central region, where h is approximately equal to $$m \times [\Phi \pm (\phi(\Theta = 0) - \phi(\Theta = \Theta_0))] \times \frac{\pi}{180} \times \frac{\lambda}{2\pi} \times \frac{1}{2},$$

where m is a positive odd integer, $\Phi$ is a desired amount of phase shift of an outer region of a phase front for reflecting off of the reflector, $\phi$ is a feed phase contribution for an angle $\Theta$, and $\Theta_0$ is an angle formed between an axis of the at least one feed and a line connecting a phase center of the at least one feed and an inner edge of the at least one annular region.

The central region and the annular region of the reflector may be parabolically curved or may alternately be shaped. The reflector may be fed by one or more multiple-band horn antennas.

28 Claims, 14 Drawing Sheets

U.S. PATENT DOCUMENTS

| | | | | |
|---|---|---|---|---|
| 6,563,472 | B2 * | 5/2003 | Durham et al. | 343/781 P |
| 6,759,994 | B2 * | 7/2004 | Rao et al. | 343/912 |
| 6,937,203 | B2 * | 8/2005 | Rao et al. | 343/786 |
| 7,061,447 | B1 * | 6/2006 | Bozler et al. | 343/910 |
| 7,084,836 | B2 * | 8/2006 | Espenscheid et al. | 343/914 |
| 7,280,081 | B2 * | 10/2007 | Mahr | 343/781 CA |
| 2002/0018023 | A1 | 2/2002 | Durham et al. | |

FOREIGN PATENT DOCUMENTS

| | | | |
|---|---|---|---|
| DE | 2416541 | A1 | 10/1975 |
| FR | 2477725 | | 9/1981 |
| FR | 2701169 | | 8/1994 |

* cited by examiner

500

510

- Beam diameter = 0.6°, Beam Spacing = 0.52°
- Number of beams = 68
- Orbital Location = 105°W
- Frequency Bands : TX=18.3 to 20.2GHz; RX=28.35 to 30.0 GHz (48.4% bandwidth)

STEPPED-REFLECTOR ANTENNA FOR SATELLITE COMMUNICATION PAYLOADS

CROSS-REFERENCE TO RELATED APPLICATION

The present application claims the benefit of priority under 35 U.S.C. §119 from U.S. Provisional Patent Application Ser. No. 60/693,832 entitled "ENHANCED STEPPED-REFLECTOR ANTENNA SYSTEM FOR DUAL-BAND MULTIPLE BEAM SATELLITE PAYLOADS," filed on Jun. 27, 2005, the disclosure of which is hereby incorporated by reference in its entirety for all purposes.

FIELD OF THE INVENTION

The present invention generally relates to antenna systems and, in particular, relates to a stepped reflector antenna ("SRA") for use in multiple beam antenna systems.

BACKGROUND OF THE INVENTION

Dual-band antenna systems, operating simultaneously at both uplink and downlink frequencies of a multiple beam communication satellite, have the advantage of using half the number of reflectors and half the number of feed horns, when compared with a conventional multiple beam antenna ("MBA") with a separate set of reflector antennas for each uplink and downlink band. Moreover, such dual-band antenna systems can increase usable space on the spacecraft for other payloads and cost less than conventional MBAs.

Although this type of antenna system is significantly better than conventional MBA systems, the receive ("Rx") beams suffer from large peak-to-edge gain variations due to an electrically larger reflector size. For example, the reflector is about 50% larger for Rx beams when the reflector is sized for transmit ("Tx") beams. One approach to compensate for this involves shaping the reflector surface such that it is heavily optimized for Rx frequencies and less optimized for Tx frequencies. Even with this compensation, such a dual-band antenna system suffers from peak-to-edge gain variation of about 5.0 dB to 7.0 dB at the Rx band with 1.0 dB to 2.0 dB gain loss due to pointing error and about 0.5 dB lower gain at the Tx band.

It is therefore considered highly desirable to provide for an antenna system which overcomes the deficiencies discussed above. In particular, it is desirable to provide an improved reflector antenna and to provide a novel MBA system that produces "flat top" Rx beams and more efficient Gaussian transmit beams.

SUMMARY OF THE INVENTION

In accordance with the present invention, a stepped reflector antenna is provided. The reflector has an annular region that is axially stepped a height h above or below the central region. The height h is chosen to create a desired 180° phase reversal at a receive frequency of the reflected phase front near the edge of the central region, to reduce peak-to-edge gain variation. When used in a multiple-band antenna system, this stepped annular region can improve the performance of one band without requiring the antenna be reshaped to heavily optimize for one band or another.

According to one embodiment, the present invention is a reflector for being fed by at least one antenna. The reflector includes a central region and at least one annular region surrounding the central region, axially stepped a height h above or below the central region.

According to another embodiment, the present invention is a reflector for being illuminated by at least one feed. The reflector includes a central region and a first annular region with an annular width of $w_1$. The first annular region surrounds the central region, and is axially stepped a height $h_1$ above the central region. Height $h_1$ is approximately equal to $$m_1 \times [\Phi_1 \pm (\phi(\Theta = 0) - \phi(\Theta = \Theta_0))] \times \frac{\pi}{180} \times \frac{\lambda}{2\pi} \times \frac{1}{2},$$

where $m_1$ is a positive odd integer, $\Phi_1$ is a desired amount of phase shift of an outer region of a phase front for reflecting off of the reflector, $\phi$ is a feed phase contribution for an angle $\Theta$, and $\Theta_0$ is an angle formed between an axis of the at least one feed and a line connecting a phase center of the at least one feed and an inner edge of the first annular region.

According to yet another embodiment, the present invention is a multiple-beam antenna system including a reflector having a central region and a first annular region, the first annular region having an annular width $w_1$ surrounding the central region, the first annular region axially stepped a height $h_1$ above or below the central region. The system further includes at least one multiple-band feed for illuminating the reflector. The at least one multiple-band feed is configured for providing transmission and reception of signals over respective transmission and reception frequency bands. Height $h_1$ is approximately equal to $$m_1 \times [\Phi_1 \pm (\phi(\Theta = 0) - \phi(\Theta = \Theta_0))] \times \frac{\pi}{180} \times \frac{\lambda}{2\pi} \times \frac{1}{2},$$

where $m_1$ is a positive odd integer, $\Phi_1$ is a desired amount of phase shift of an outer region of a phase front for reflecting off of the reflector, $\phi$ is a feed phase contribution for an angle $\Theta$, and $\Theta_0$ is an angle formed between an axis of the at least one feed and a line connecting a phase center of the at least one feed and an inner edge of the first annular region.

Additional features and advantages of the invention will be set forth in the description below, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail to avoid unnecessarily obscuring the present invention.

Figure 1:
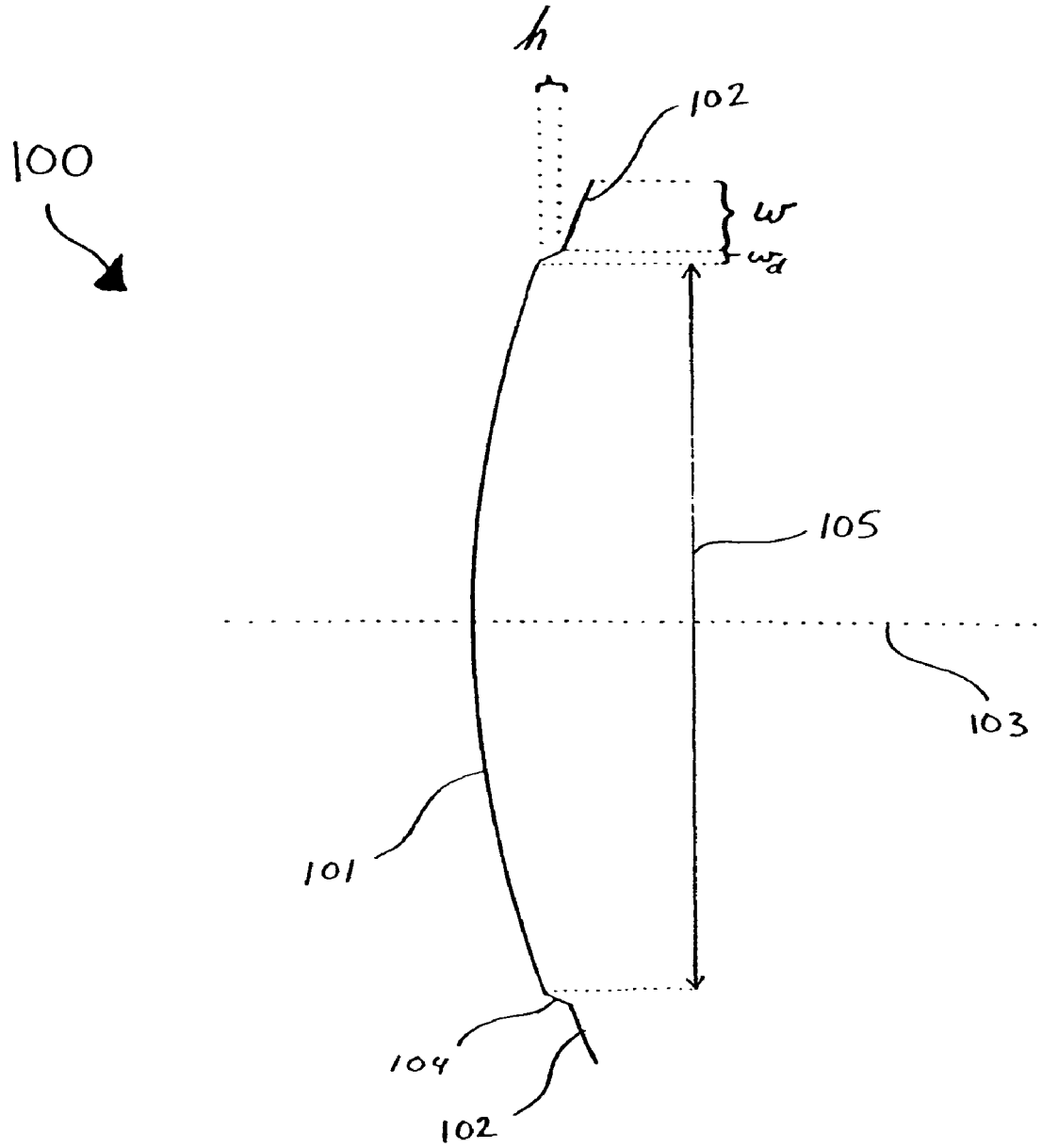
FIG. 1 illustrates a schematic profile of a stepped reflector according to one embodiment of the present invention.

FIG. 1 illustrates a schematic profile of a stepped reflector according to one embodiment of the present invention. Stepped reflector 100 includes a central region 101 and an annular region 102 surrounding central region 101. Central region 101 has a diameter 105. Annular region 102 has an annular width w, and is axially stepped a height h above central region 101 along axis 103. In the present illustration, the size of height h has been exaggerated for clarity. Between annular region 102 and central region 101, stepped reflector 100 includes a discontinuity region 104. Discontinuity region 104 has an annular width of $w_d$. In the exemplary embodiment illustrated in FIG. 1, the discontinuity region is an abrupt discontinuity, (e.g., corners delineate the beginning and end of the discontinuity region). In alternate embodiments, the discontinuity region may be a smooth discontinuity (e.g., in which the region does not include sharp corners).

As will be apparent to one of skill in the art, the scope of the present invention is not limited to stepped reflector antennas with particular physical dimensions, as the stepped reflector concept is applicable for any wavelength of radiation, which is one determining factor when choosing an antenna's dimensions. According to one embodiment of the antenna designed to operate in the $K_a$ band (18 GHz-40 GHz), for example, the central region 101 of stepped reflector antenna may be between 60 inches and 120 inches. According to other embodiments, central region 101 may be larger or smaller, according to the various requirements of its design.

Annular region 102 may similarly be nearly any physical dimension. As will be apparent to one of skill in the art, the proportion of annular width w to the diameter m of central region 101 may determine what portion of the outer region of a reflected phase front will experience a phase shift. Accordingly, the selection of annular width w will depend upon the requirements of the design of reflector 100. According to one embodiment, annular width w may be between 5% and 15% of diameter m of central region 101. The scope of the present invention is not limited to annular regions of these dimensions, however, and may encompass annular regions of nearly any annular width.

Discontinuity region 104 may be configured in a number of ways. According to one embodiment, discontinuity region 104 is a smooth discontinuity, having an annular width $w_d$ of no more than 0.5 inches. In other embodiments, discontinuity region 104 may have a larger or smaller annular width, even of 0 inches (e.g., in an abrupt discontinuity where the discontinuity region is oriented parallel to axis 103).

The stepped design of stepped reflector 100 enables the reflector to modify the shape of a reflected phase front. For example, if h is approximately equal to (e.g., within 25% of) an odd multiple of one fourth of the wavelength of an incident wavefront, then the reflected phase front will be modified near its outer regions by a phase shift of approximately 180°. For a phase front which is substantially uniform over the stepped reflector 100, this phase reversal results in a "flat-topped" beam pattern with a greatly reduced peak-to-edge gain variation.

Figure 2:
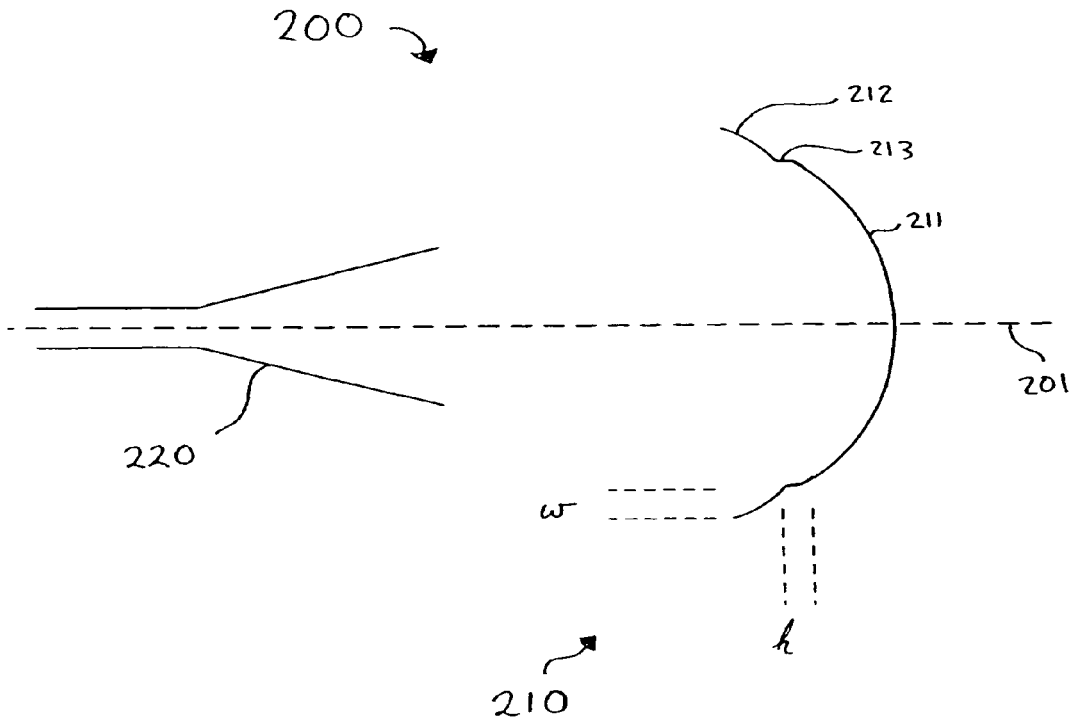
FIG. 2 illustrates a partial view of a multiple-beam antenna system implementing a stepped reflector, according to another embodiment of the present invention.

In a dual band multiple-beam antenna (MBA) system employing a stepped reflector of the present invention, this phase front modification can be used to improve the Rx performance of the system without significantly compromising its Tx performance. FIG. 2 illustrates a single reflector 210 and a single dual-band feed 220 for illuminating reflector 210 of a multiple-beam antenna system 200 according to one embodiment of the present invention. Reflector 210 is a stepped reflector, including a central region 211 and an annular region 212. Annular region 212 has an annular width w, and is axially stepped a height h above central region 212 along axis 201. Between annular region 212 and central region 211, stepped reflector 210 includes a discontinuity region 213. In the exemplary embodiment illustrated in FIG. 2, the discontinuity region 213 is a smooth discontinuity (e.g., in which the region does not include sharp corners).

Dual-band antenna 220 is characterized by a broadcast frequency band and a reception frequency band. Height h is selected to accomplish an integer multiple of 180° phase shift at the edge region of the beam reflected from reflector 210. For phase fronts which are uniform over the surface of reflector 210, h may be approximately equal to an odd multiple of one fourth of a reception wavelength corresponding to a reception frequency in the reception frequency band of dual-band antenna 220. Because the annular region that reflects the outer region of the phase front is axially stepped a quarter-wavelength multiple, the reflected phase front at the reception frequency will be modified near its outer regions by a phase shift of approximately 180°. This phase shift results in a "flat-topped" beam pattern at the reception frequency with a greatly reduced peak-to-edge gain variation.

If the feed phase pattern are not uniform within the reflector subtended angle corresponding to the diameter of the central region, (e.g., in MBA systems where a phase center of a feed antenna is not disposed in the focal plane of the reflector), the phase variation of the incident wavefront over the annular region may be taken into consideration when selecting the height h by which the annular region is to be stepped. One example of an MBA where height h has taken into account feed-induced phase variations is illustrated in FIG. 3.

Figure 3:
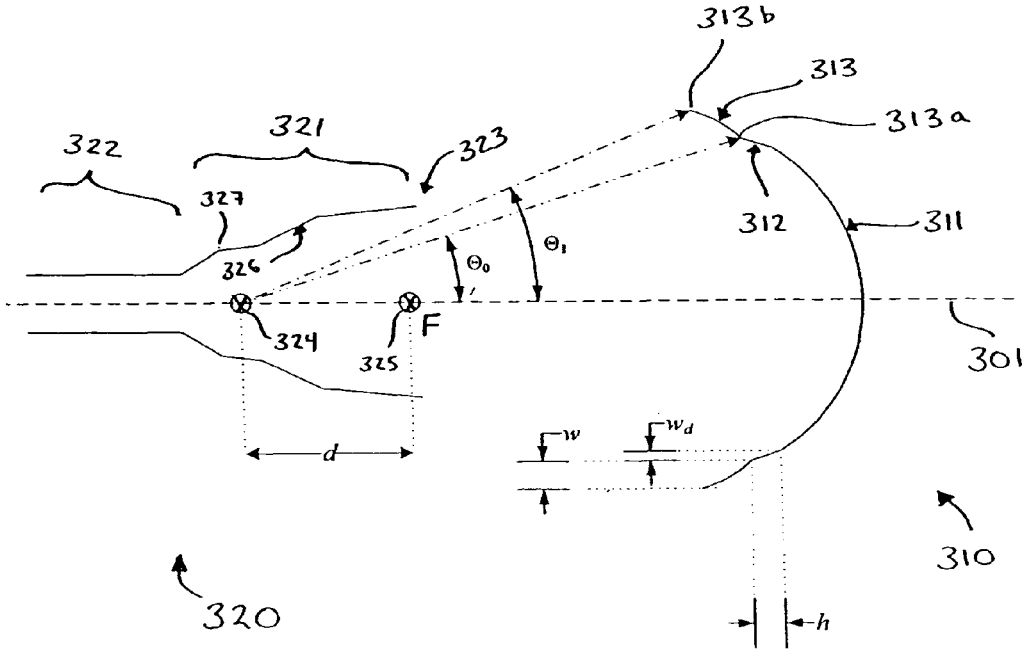
FIG. 3 illustrates a partial view of a multiple-beam antenna system implementing a stepped reflector, according to yet another embodiment of the present invention.

FIG. 3 illustrates a single reflector 310 and a single high efficiency dual-band horn antenna 320 for illuminating reflector 310 of a multiple-beam antenna system 300 according to another embodiment of the present invention. Stepped reflector 310 includes a central region 311, which, according to one aspect, may have a parabolic curvature. According to another aspect, central region 311 may be shaped (e.g., having regions with curvature varying from parabolic) to optimize the reflector for being fed by more than one dual-band antenna. Stepped reflector 310 further includes an annular region 313 with an annular width w, axially stepped a height h along axis 301 above central region 311. According to one aspect, annular region 313 may have a parabolic curvature. In alternate aspects, annular region 313 may be shaped to optimize stepped reflector 310 for being fed by more than one dual-band antenna. Between annular region 313 and central region 311 is disposed a discontinuity region 312 having an annular width $w_d$. In the present exemplary embodiment, height h and discontinuity region 312 have been exaggerated for clarity.

Discontinuity region 312 may be an abrupt discontinuity region (e.g., characterized by corners on either side), a smooth discontinuity region (e.g., not having corners), or a combination of the two (e.g., having an abrupt transition between the discontinuity region and the central region, and a smooth transition between the discontinuity region and the annular region).

High efficiency dual-band horn antenna 320 has a Rx phase center 324 and a Tx phase center 325. A MBA system of the present invention may exploit this phase center variation to minimize the height h of stepped reflector 310. In the present exemplary embodiment, Tx phase center 325 is disposed at the focal point F of stepped reflector 310. Because high-efficiency dual band horn antenna 320 of the present embodiment is not a frequency independent horn, Rx phase center 324 is located a distance d along axis 301 from focal point F. Thus, a wavefront at the reception frequency corresponding to Rx phase center 324 may be non-uniform over annular region 313 of stepped reflector 310. According to one aspect of the present invention, the phase variation from the phase on axis, Δ Phase, can be determined for a given angle Θ according to Equation 1, in which d is the distance between the Rx phase center 324 and focal point F, and k is the circular wavenumber (e.g., 2π/λ for radians or 360/λ for degrees) for a Rx wavelength λ:

$$\Delta\text{Phase}=kd/(1-\cos\Theta_0) \quad [1]$$

For example, for an antenna system in which $\Theta_0$=30°, d=0.5 in., and λ=0.4 in.$^{-1}$ (~30 GHz), ΔPhase=1.05 rad or 60°.

While the phase variation may be determined by Equation 1, it will be apparent to those of skill in the art that the phase variation may, according to another aspect of the present invention, be determined with modeling or simulation software.

While the present exemplary embodiment describes an embodiment of the invention applicable to a stepped reflector fed by a multiple-band antenna, it will be understood by one of skill in the art that the present invention has application to antenna systems fed by single-band antennas, in which distance d can similarly be determined as the distance between a phase center of the single-band antenna and the focal plane (or focal point, if the antenna and reflector share an axis) of the stepped reflector.

In this manner, the phase variation at annular region 313 can be determined with reference to Equation 1, of with modeling or simulation software, by comparing the phase on axis with the phase at angle $\Theta_0$, where $\Theta_0$ is an angle between axis 301 and a line connecting Rx phase center 324 and the inner edge 313*a* of annular region 313. According to another aspect of the present invention, angle $\Theta_1$ between axis 301 and a line connecting Rx phase center 324 and the outer edge 313*b* of annular region 313 may be used to calculate the phase variation at a second annular region (not shown). This phase variation, which is introduced by the feed antenna, is hereinafter referred to as the feed phase contribution ϕ.

Returning to the exemplary embodiment, in which $\Theta_0$=30°, d=0.5 inch, and λ=0.4 inches (~30 GHz), the feed phase contribution $\phi(\Theta_0)$ at the annular region is 60°. To accomplish the desired 180° phase shift at the outer region of the reflected phase front, h should be selected to accomplish an additional 120° (180°−60° of phase shift, according to Equation 2, in which m is a positive odd integer:

$$h = m \times [180 \pm (\phi(\Theta = 0) - \phi(\Theta = \Theta_0))] \times \frac{\pi}{180} \times \frac{\lambda}{2\pi} \times \frac{1}{2} \quad [2]$$

The feed phase contribution ϕ at the axis (when Θ=0) is 0, as can easily be seen with reference to Equation 1. Thus, Equation 2 solves to an odd multiple m of 0.067 inches to accomplish the desired 180° phase shift at the edge regions of the reflected phase front. Where minimizing the step height h is desired, a value of 1 can be selected for m. Where minimizing the step height h is not desired, m may be any positive odd integer.

The ± sign in Equation 2 indicates the need to consider the direction of the phase shift accomplished by the feed phase contribution when determining whether to add or subtract the contribution from the desired phase shift of 180°. The plus sign is used when the phase center is closer to the stepped reflector than is the focal plane, and the minus sign is used when the phase center is further from the stepped reflector than is the focal plane.

When a stepped reflector with multiple annular regions is designed, the height $h_n$ that a given annular region is stepped above the previous region (whether the previous region is an annular region or the central region) can be determined by a Equation 3, in which the feed phase contribution for a given annular region $\phi(\Theta_n)$ is determined with reference to the phase of the previous region $\phi(\Theta_{n-1})$. When the previous region is the central region, the feed phase contribution $\phi(0)$ will of course be 0.

$$h = m \times [180 \pm (\phi(\Theta_{n-1}) - \phi(\Theta_n))] \times \frac{\pi}{180} \times \frac{\lambda}{2\pi} \times \frac{1}{2} \quad [3]$$

For some applications, it may be desirable to phase shift the outer regions of the reflected phase front by an amount other than 180°. In such an application, Equation 2 may be modified to select a height h to accomplish a desired phase shift Φ. Equation 4 may be used to determine a step height h by which to step an annular region to accomplish a phase shift of the outer regions of a reflected phase front by Φ degrees:

$$h = m \times [\Phi \pm (\phi(\Theta = 0) - \phi(\Theta = \Theta_0))] \times \frac{\pi}{180} \times \frac{\lambda}{2\pi} \times \frac{1}{2} \quad [4]$$

Thus, according to one embodiment, a stepped reflector of the present antenna may have an annular region axially stepped a height h above or below the central region, where h is determined by Equation 4. In other embodiments, h may be approximately equal to (e.g., within 25% of) the value determined by Equation 4.

While the present exemplary embodiment has illustrated a stepped reflector fed by only one antenna, it will be understood by those of skill in the art that a multiple beam antenna system of the present invention encompasses reflectors fed by more than one multiple-band antenna. In such an embodiment, the Tx phase center of each multiple-band feed antenna will be disposed at or near the focal plane of stepped reflector, rather than at the focal point of the stepped reflector. Moreover, while FIGS. 2 and 3 have illustrated a feed antenna and a reflector sharing a common axis, it will be understood that when multiple feed antennas are utilized, each may be disposed on its own axis, which may or may not coincide with the axis of the reflector.

In an alternate embodiment, a stepped reflector of the present invention may be illuminated by a single multiple-band feed in a contour antenna system, in which multiple contoured beams are generated by a single feed reflecting a phase front off of shaped regions of a stepped reflector.

One type of high efficiency dual-band horn antenna that may be used in conjunction with a stepped reflector of the present invention can provide signal transmission and reception over widely separated respective transmission and reception frequency bands. Referring back to FIG. 3, according to one embodiment, high efficiency dual-band horn antenna 320 includes a substantially conical wall 321 that flares from the throat section 322 of the horn to the horn aperture 323 and has an internal surface 326 with a variable slope. The internal surface of the substantially conical wall may have a number of slope-discontinuities, such as slope discontinuities 327, configured for generating desired higher order modes over the transmission and reception frequency bands. Different numbers of slope-discontinuities may be provided on the internal surface of the conical wall depending on the aperture size and overall bandwidth required. The slope-discontinuities are provided to broaden bandwidth and improve the horn efficiency over very wide bandwidths to support transmission and reception over widely separated transmission and reception frequency bands.

The diameter of the throat section of high efficiency dual-band horn antenna 320 may be selected to allow the throat section to propagate only the dominant mode over the transmission frequency band. The substantially conical wall 321 may contain a phasing section having a permanent slope. The phasing section may be configured to ensure that all modes add in a proper phase relationship with the dominant mode at the aperture. By contrast with conventional feed horns, the internal surface 326 of the substantially conical wall 321 is free from recesses, flares or corrugations all the way from the throat section 322 to the aperture 323 to maintain high horn efficiency (e.g., 85% to 90%) over widely separated transmission and reception frequency bands. For example, a frequency band from 18.3 GHz to 20.2 GHz may be used for transmission, and a frequency band from 28.3 GHz to 30.0 GHz may be employed for reception.

While dual-band horn antenna 320 has been described as having two frequency bands, in yet another embodiment of the present invention, a multiple-band feed with any number of frequency bands may be used to illuminate a stepped reflector. For example, a multiple-band feed may have one Tx frequency band and multiple Rx frequency bands, multiple frequency bands for both Tx and Rx, or one Rx frequency band and multiple Tx frequency bands.

Figure 4:
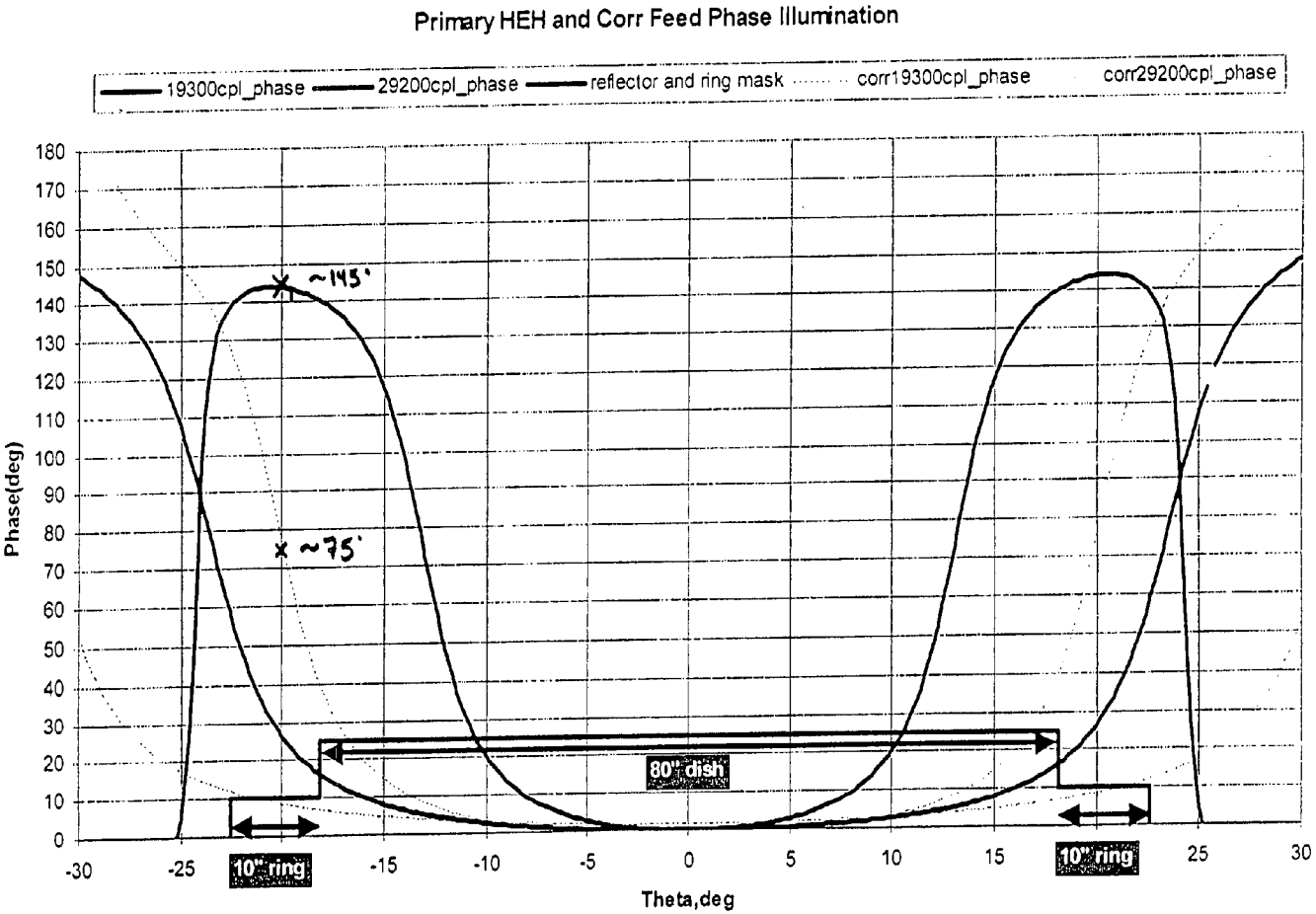
FIG. 4 illustrates a performance advantage of illuminating a stepped reflector antenna with a high efficiency horn antenna according to one aspect of the present invention.

FIG. 4 illustrates, according to one aspect of the present invention, the improved feed phase illumination delivered by a high efficiency horn antenna when compared against a more conventional corrugated horn antenna. As can be seen with reference to the graph in FIG. 4, the feed phase contribution of the high efficiency horn at the annular region of the stepped reflector antenna is approximately 145° at the receive frequency of 29.2 GHz, as opposed to the 75° contribution provided by the corrugated horn at the same frequency.

Figure 5A:
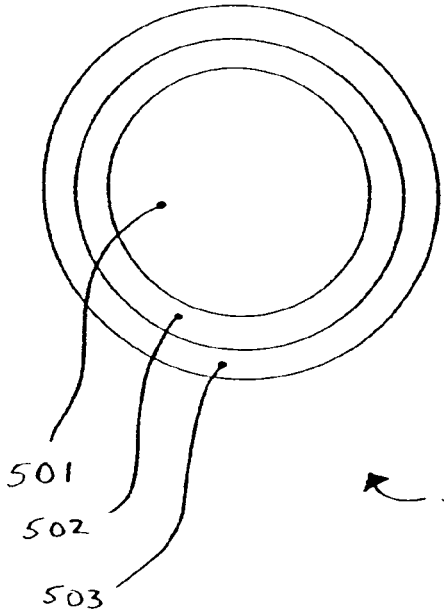
FIGS. 5A-5D illustrate various configurations of a stepped reflector according to various aspects of the present invention.
Figure 5B:
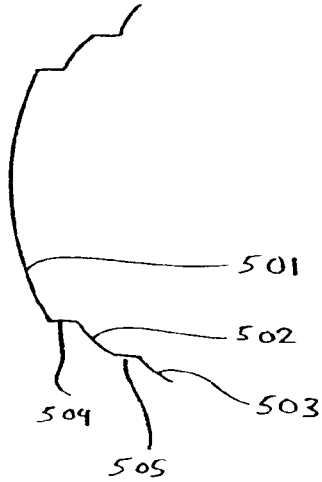
Figure 5C:
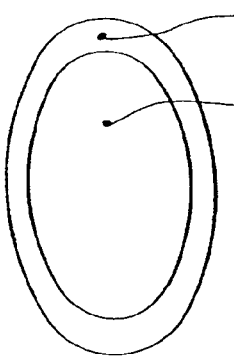
Figure 5D:
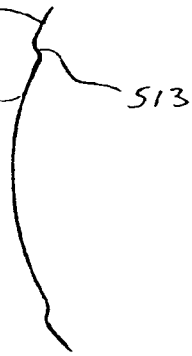

While the stepped reflectors in FIGS. 1, 2 and 3 have been illustrated as circular in shape and including only one annular region, the scope of the present invention is not limited to this particular configuration. For example, FIGS. 5A and 5B illustrate a stepped reflector 500 with two annular regions 502 and 503. An abrupt discontinuity region 504 separates annular region 502 from central region 501, and another abrupt discontinuity region 505 separates annular region 503 from annular region 502. In another embodiment, the discontinuity regions 504 and 505 may be smooth. A multiple-step reflector antenna such as reflector 500 may be utilized with a tri-band feed antenna, where the axial height of each step between an annular region and the region preceding it is determined as discussed more fully above. FIGS. 5C and 5D illustrate a stepped reflector 510 with an elliptical shape. Stepped reflector 510 includes an elliptical central region 511, an annular region 512 axially stepped below central region 511, and a smooth discontinuity region 513 between annular region 512 and central region 511. In another embodiment, discontinuity region 513 may be abrupt. In additional embodiments, stepped reflectors of the present invention may be n-sided polygonal in shape, such as, for example, square, hexagonal, octagonal, etc.

Figure 6A:
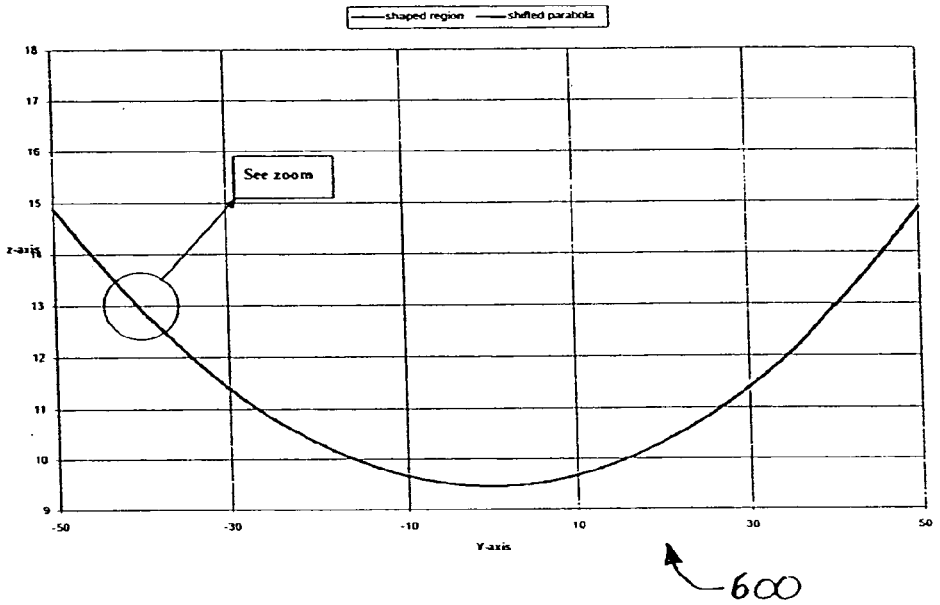
FIGS. 6A and 6B depict a surface plot of a stepped reflector according yet another embodiment of the present invention.
Figure 6B:
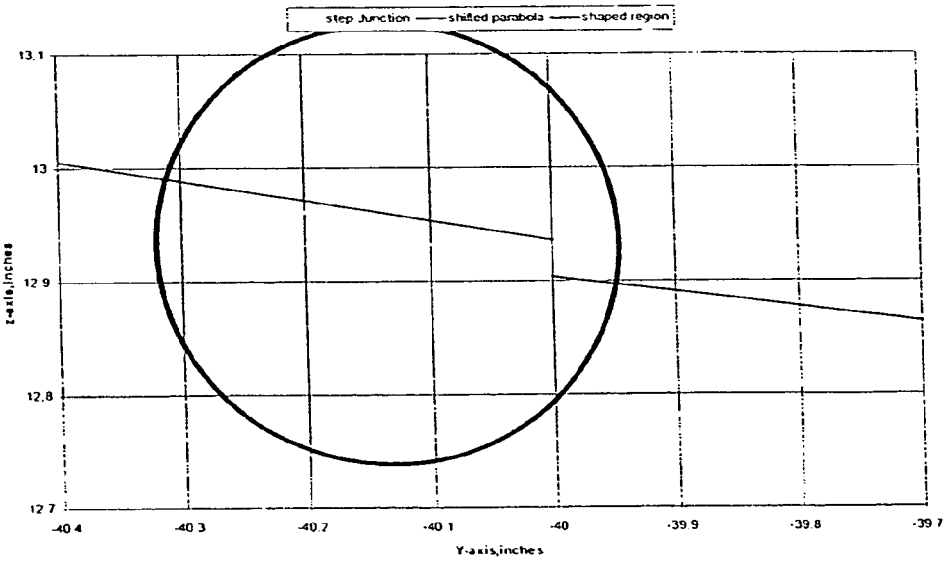

FIG. 6A depicts the dimensions of a stepped reflector antenna 600 according to one embodiment of the present invention used to obtain the experimental results discussed below. Stepped reflector antenna 600 has a circular, parabolically-curved central region with a diameter of 80 inches. Stepped reflector antenna 600 further has an annular region with an annular width of 10 inches, axially stepped a height 0.04 inches above the central region. The axial step can be better seen in FIG. 6B, a partial zoomed view of stepped reflector antenna 600.

The performance advantages of stepped reflector antenna 600 are illustrated in Table 1, which summarizes the improved minimum edge-of-coverage (EOC) directivity in dBi of a stepped reflector antenna over a conventional reflector for a Rx frequency, both with and without accounting for pointing error (PE):

TABLE 1

| | Conventional 100" Reflector | | | 80" Stepped Reflector Plus 10" Annular Ring | | | delta |
|---|---|---|---|---|---|---|---|
| coverage | left | right | average | left | right | average | average |
| w/o PE | 46.49 | 47.14 | 46.82 | 47.68 | 46.76 | 47.22 | 0.41 |
| w/ PE | 45.58 | 45.58 | 45.58 | 47.12 | 45.66 | 46.39 | 0.81 |

Figure 7:
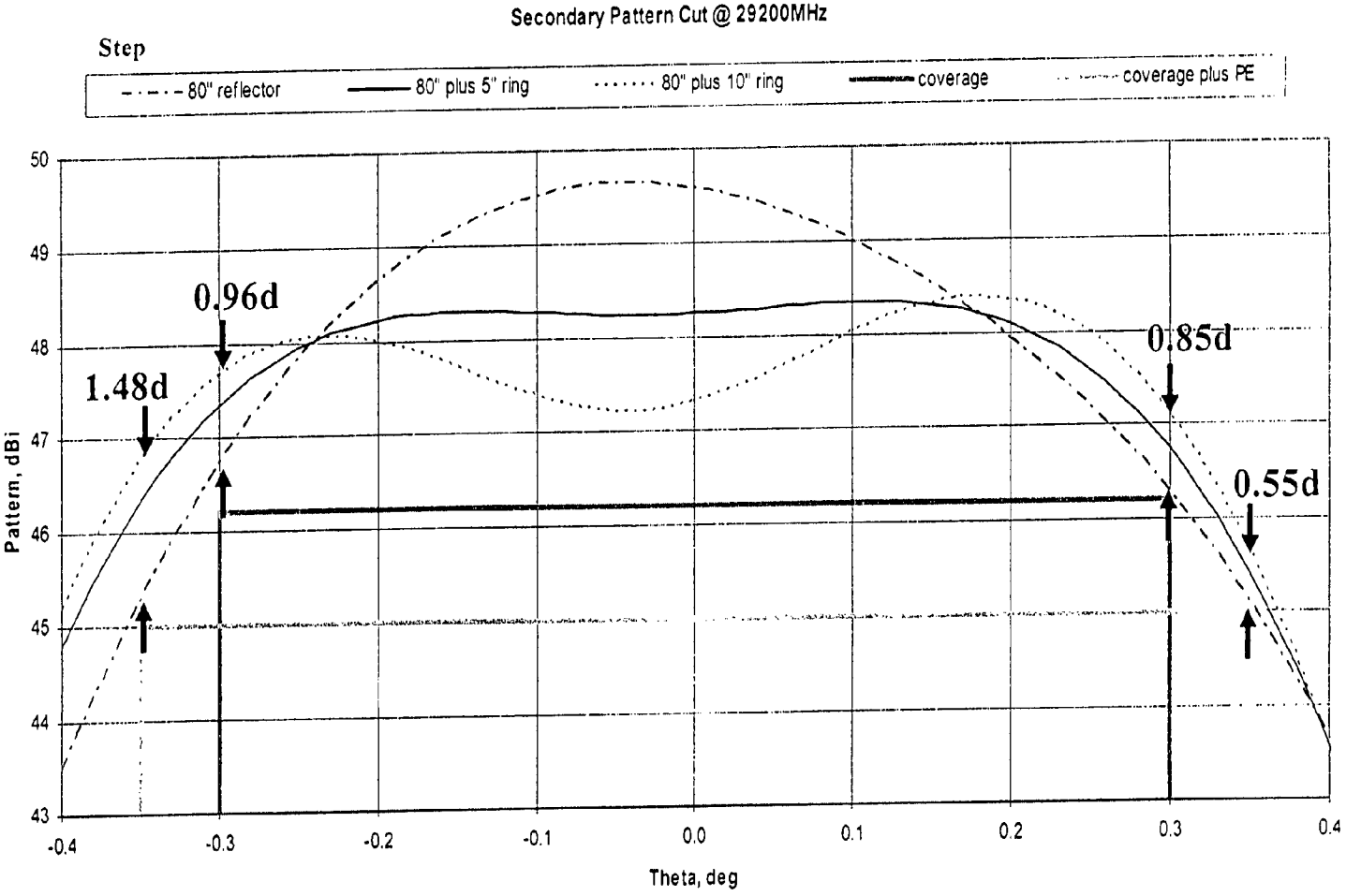
FIG. 7 is a graph illustrating the performance advantage of a stepped reflector according to yet another embodiment of the present invention.

In FIG. 7, the secondary pattern amplitude of a reflected phase front is diagrammed over a varying angle for three different reflector antennas. The chart in FIG. 7 shows the secondary pattern amplitudes of (i) an 80" diameter reflector antenna, (ii) a reflector antenna with an 80" diameter central region and an annular region, which annual region having an annular width of 5" and stepped an axial height of 0.10" above the central region, and (iii) a reflector antenna with an 80" diameter central region and an annular region, which annual region having an annular width of 10" and stepped an axial height of 0.10" above the central region. As can be seen with reference to FIG. 7, the secondary pattern of the reflector antennae with stepped annular regions exhibit a "flat-top" pattern shape, corresponding to a reduced peak-to-edge gain variation.

Figure 8:
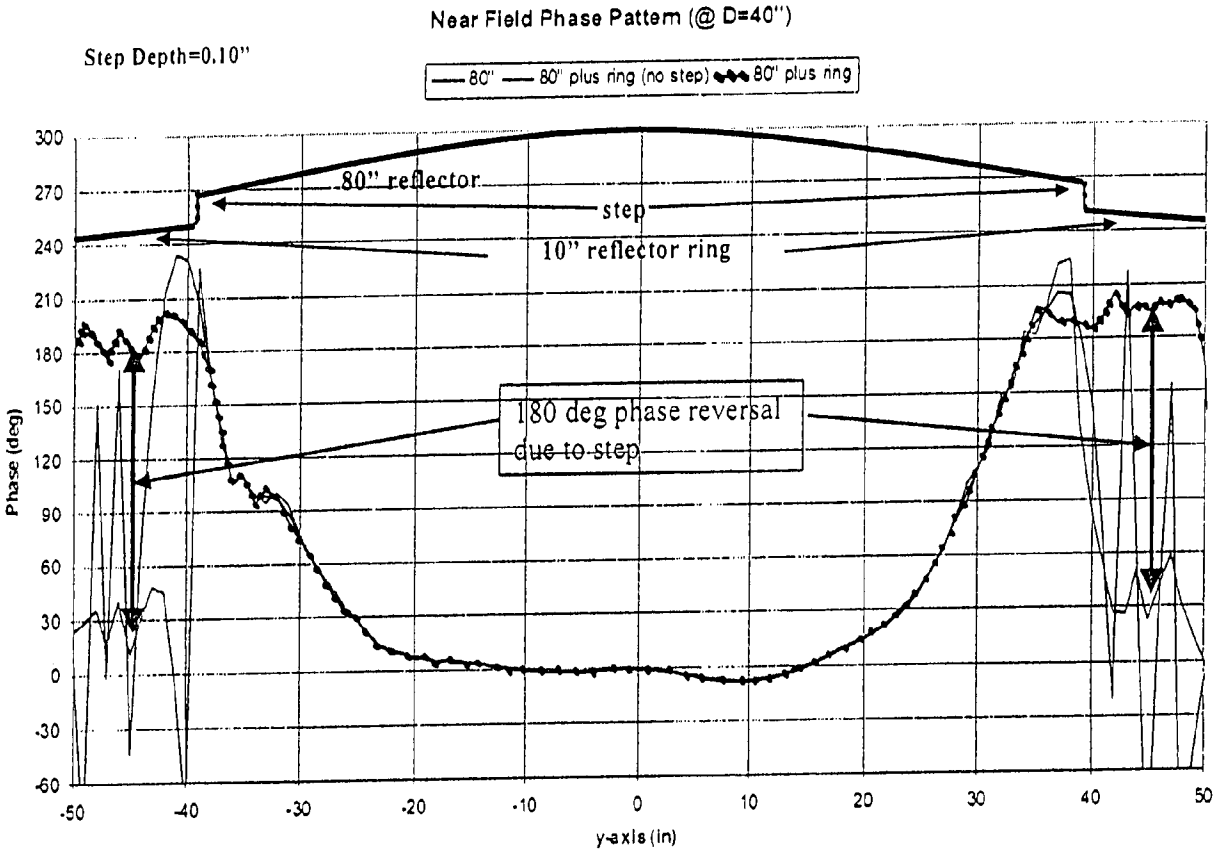
FIG. 8 is a graph illustrating the performance advantage of a stepped reflector according to yet another embodiment of the present invention.

In FIG. 8, the phase of the near-field (40") aperture plane patterns of several reflector antennas are charted across the surface of the reflector antennas. An 80" diameter reflector antenna, a reflector antenna with an 80" diameter central region and an annular region having an annular width of 10" (not stepped), and a reflector antenna with an 80" diameter central region and an annular region having an annular width of 10" stepped an axial height of 0.10" above the central region are charted. As can be seen with reference to FIG. 8, the stepped annular region effectuates a 180° phase shift in the near-field aperture plane pattern.

Figure 9:
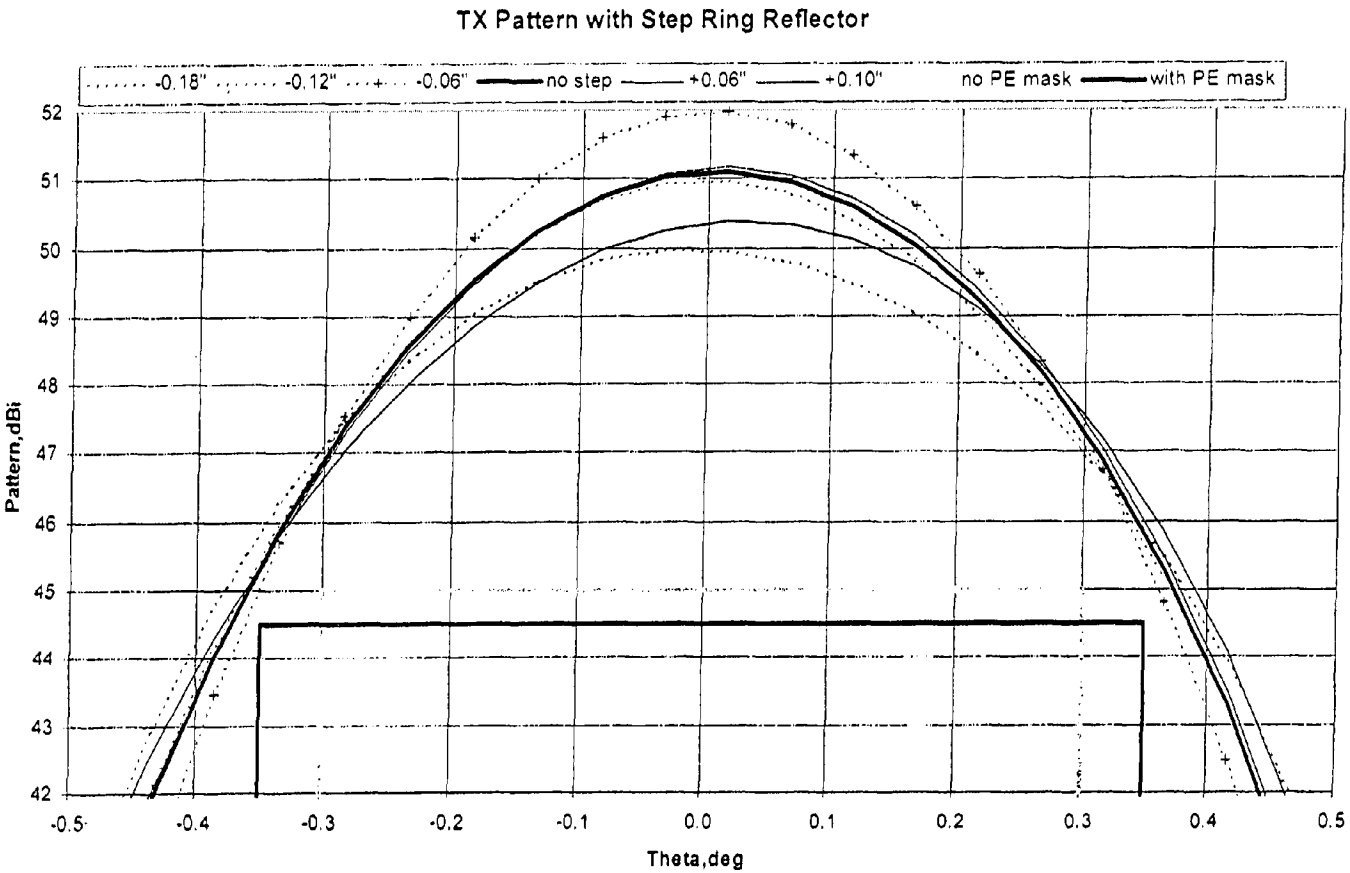
FIG. 9 is a graph illustrating various performance advantages of stepped reflector antennas with differing axial step heights.
Figure 10:
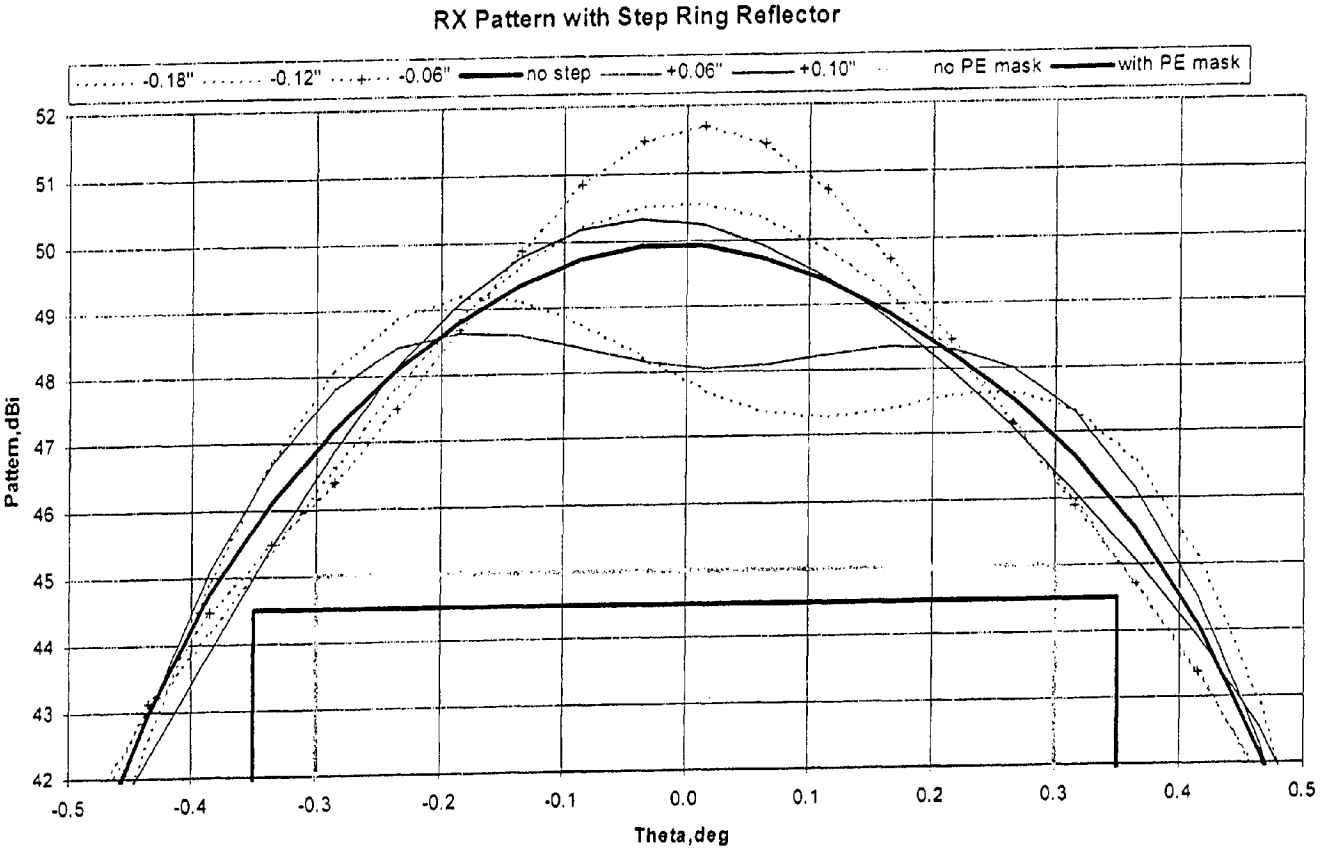
FIG. 10 is a graph illustrating various performance advantages of stepped reflector antennas with differing axial step heights.

Because the stepped reflector of the present invention is able to improve the Rx performance of the MBA antenna system without requiring the reflector be oversized or otherwise heavily optimized for Rx performance, the Tx performance of the system of the present invention does not suffer the performance degradation of other approaches, and may in fact enjoy performance benefits in the Tx frequencies when both the annular region and central region of the stepped reflector antenna are shaped (e.g., with regions of non-parabolic curvature). FIGS. 9 and 10 illustrate some of the performance advantages enjoyed by a stepped reflector according to another aspect of the present invention.

FIG. 9 illustrates the impact on Tx performance of various step heights and directions for a stepped reflector with an 80" central region and an annular region with an annular width of 10". As can be seen, the Tx phase front receives a gain boost of as much as 1.0 dBi with appropriate step height and direction. FIG. 10 illustrates the impact on Rx performance of the same various step heights and directions for the same stepped reflector antenna.

Figure 11:
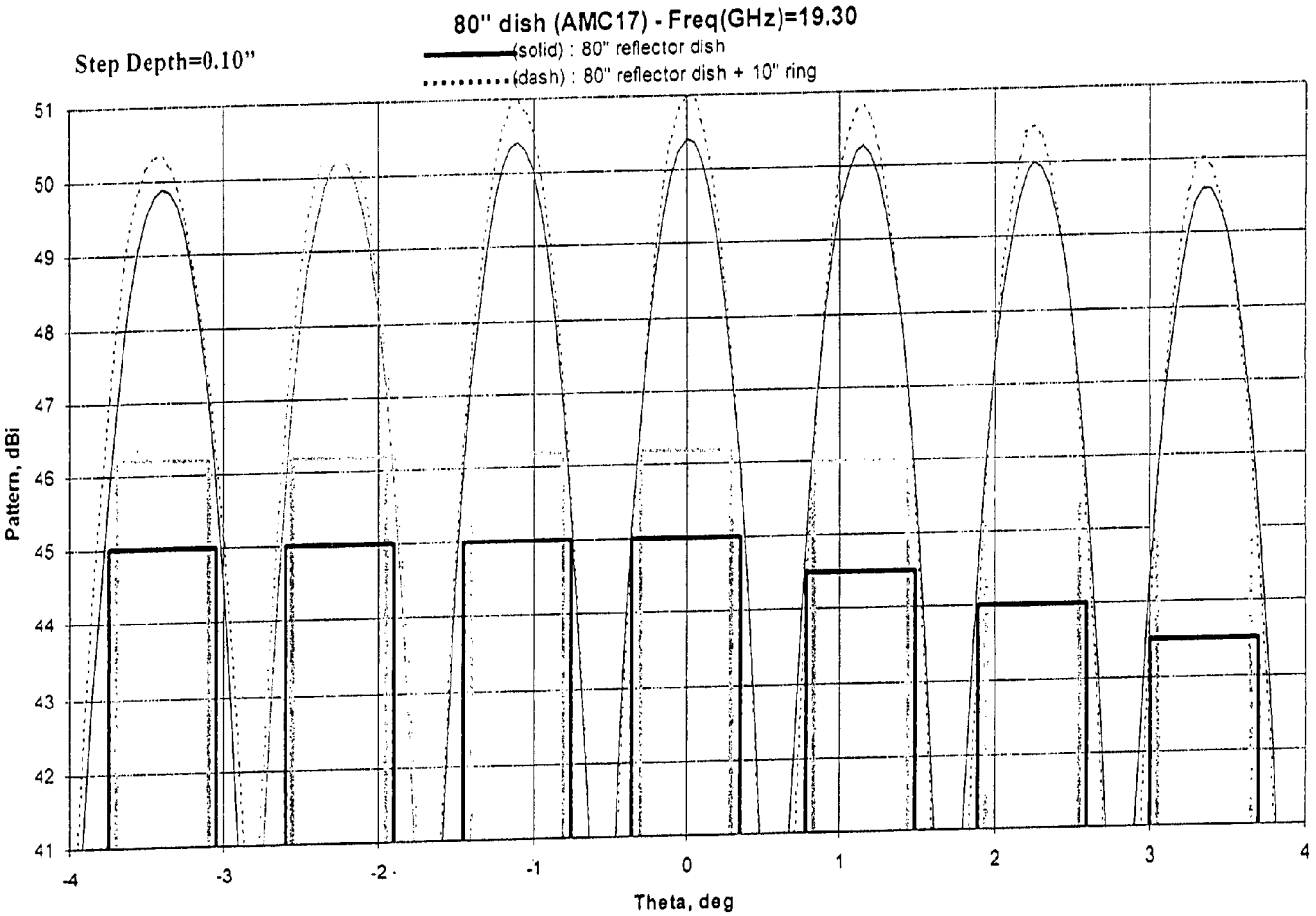
FIG. 11 is a graph illustrating a performance advantage of a stepped reflector antenna in a multiple beam antenna system according to one embodiment of the present invention.
Figure 12:
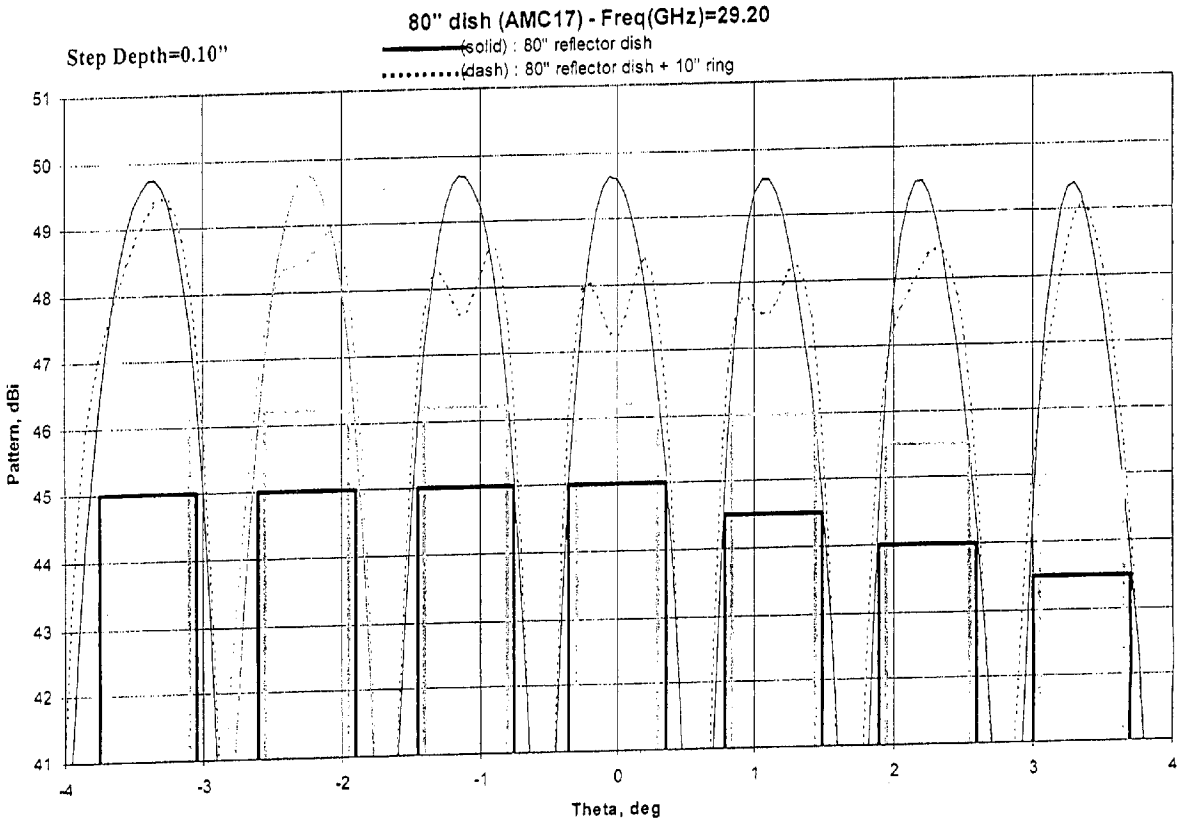
FIG. 12 is a graph illustrating a performance advantage of a stepped reflector antenna in a multiple beam antenna system according to one embodiment of the present invention.

FIGS. 11 and 12 illustrate performance advantages of a multiple beam antenna system incorporating a stepped reflector antenna according to another embodiment of the present invention. FIG. 11 compares the performance of several beams reflected from a conventional reflector and a stepped reflector in a Tx frequency, while FIG. 12 compares the performance of those beams reflected from the conventional reflector and the stepped reflector in a Rx frequency.

Figure 13A:
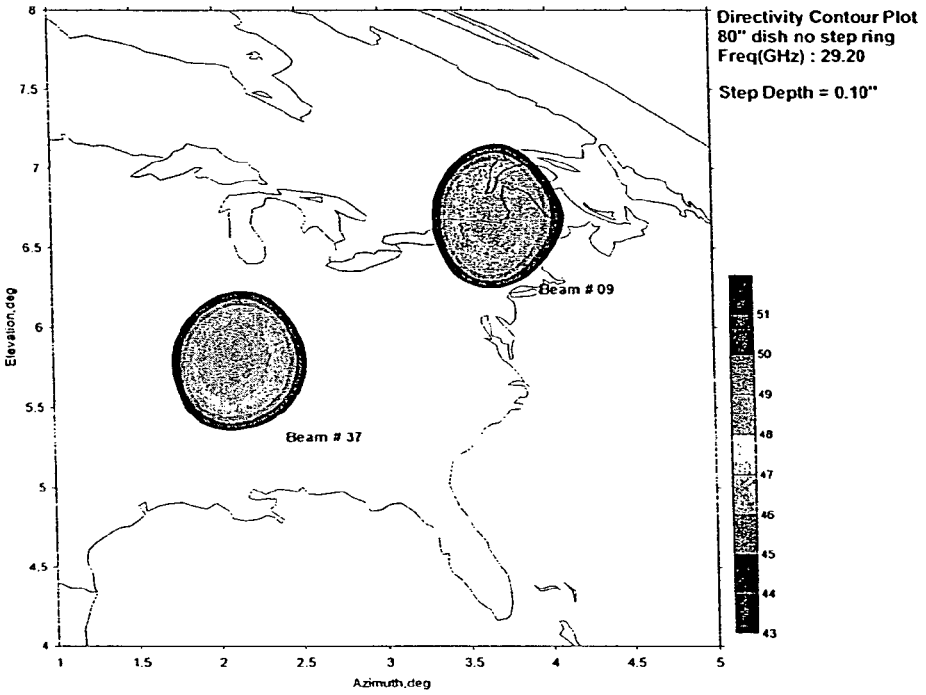
FIGS. 13A and 13B are contour plots illustrating a performance advantage of a stepped reflector antenna according to yet another aspect of the present invention.
Figure 13B:
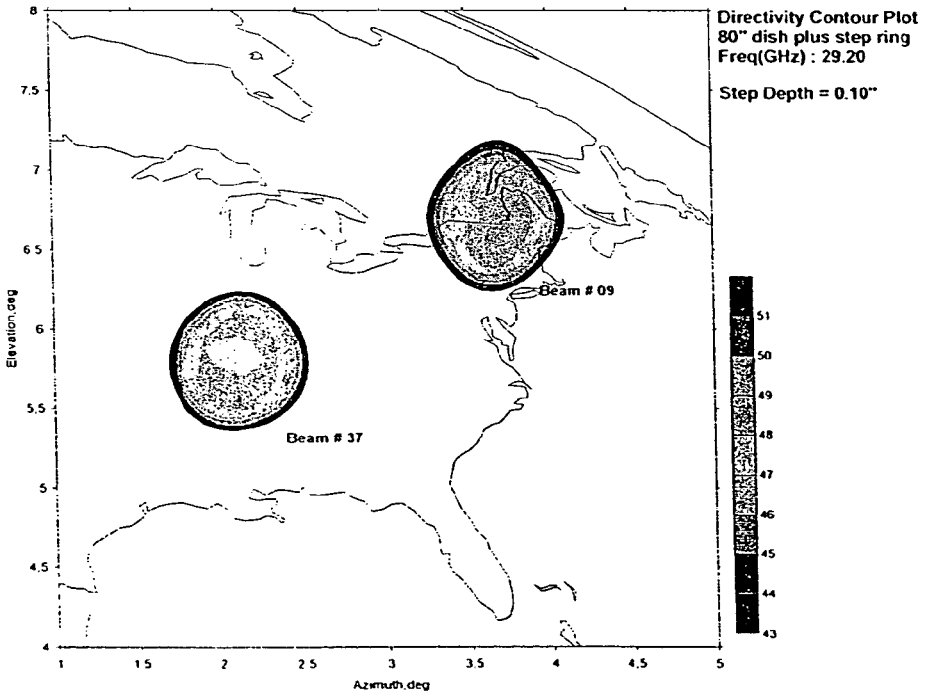
Figure 14:
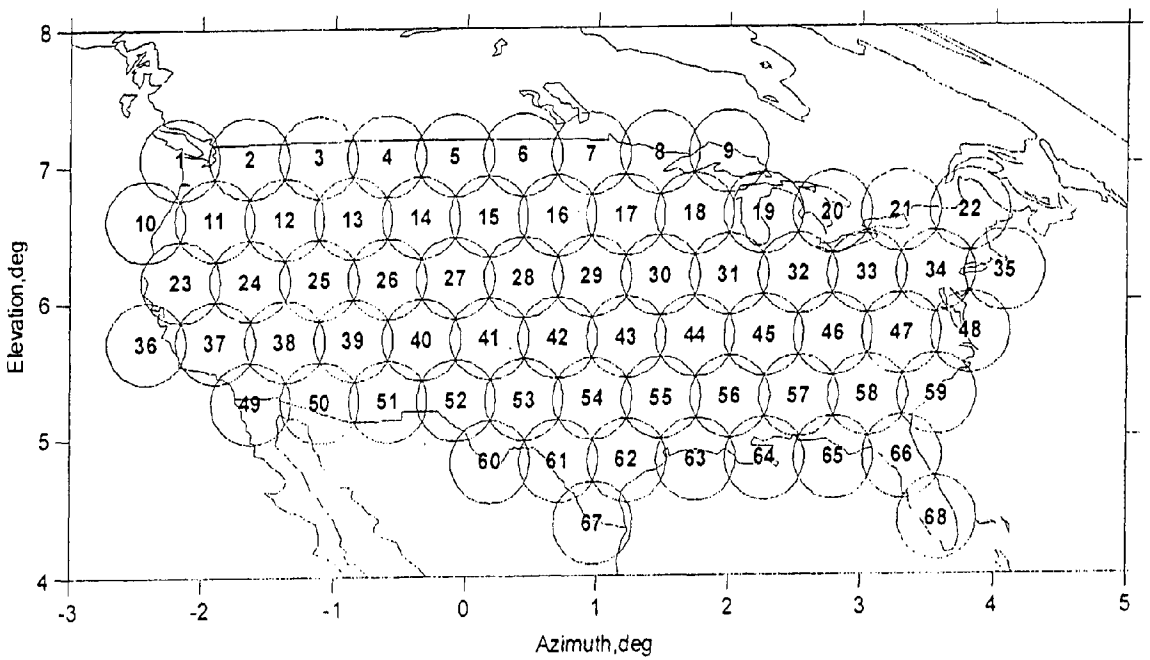
FIG. 14 illustrates a coverage plan for the continental United States using a multiple-beam or contour-beam antenna system according to yet another aspect of the present invention.

FIGS. 13A and 13B depict contour plots illustrating a performance advantage in peak-to-edge variation of a stepped reflector over a conventional reflector for both central and edge beams in a continental United States (CONUS) coverage plan. FIG. 14 illustrates a coverage plan for CONUS using a multiple-beam or contour-beam antenna system.

While the present invention has been particularly described with reference to the various figures and embodiments, it should be understood that these are for illustration purposes only and should not be taken as limiting the scope of the invention. There may be many other ways to implement the invention. Many changes and modifications may be made to the invention, by one having ordinary skill in the art, without departing from the spirit and scope of the invention.

What is claimed is:

1. A reflector for being illuminated by at least one feed, the reflector comprising:

a central region; and at least one annular region surrounding the central region, axially stepped a height h above or below the central region, wherein the height h is selected to create a 180° phase reversal between radiation reflected from the central region and radiation reflected from the at least one annular region at one of a receive or transmit frequency band, wherein h is approximately equal to $$m \times [\Phi \pm (\phi(\Theta = 0) - \phi(\Theta = \Theta_0))] \times \frac{\pi}{180} \times \frac{\lambda}{2\pi} \times \frac{1}{2},$$

where m is a positive odd integer, $\Phi$ is a desired amount of phase shift of an outer region of a phase front for reflecting off of the reflector, $\phi$ is a feed phase contribution for an angle $\Theta$, and $\Theta_0$ is an angle formed between an axis of the at least one feed and a line connecting a phase center of the at least one feed and an inner edge of the at least one annular region.

2. The reflector of claim 1, wherein the feed phase contribution $\phi$ for an angle $\Theta$ is equal to $kd(1-\cos\Theta)$, where k is a circular wavenumber corresponding to a wavelength of the phase front and d is an axial distance between a focal plane of the reflector and a phase center of the at least one feed corresponding to the wavelength of the phase front.

3. The reflector of claim 1, wherein h is approximately equal to an odd multiple of one fourth of a wavelength of an incident wavefront.

4. The reflector of claim 1, wherein the one of the receive or transmit frequency band at which a 180° phase reversal is created is a higher frequency band than the other of the receive or transmit frequency band.

5. The reflector of claim 1, wherein the reflector is used for a dual band multiple-beam antenna system.

6. A reflector for being illuminated by at least one feed, the reflector comprising:

a central region; and a first annular region with an annular width of $w_1$ surrounding the central region, the first annular region axially stepped a height $h_1$ above the central region, wherein $h_1$ is approximately equal to $$m_1 \times [\Phi_1 \pm (\phi(\Theta = 0) - \phi(\Theta = \Theta_0))] \times \frac{\pi}{180} \times \frac{\lambda}{2\pi} \times \frac{1}{2},$$

where $m_1$ is a positive odd integer, $\Phi_1$ is a desired amount of phase shift of an outer region of a phase front for reflecting off of the reflector, $\phi$ is a feed phase contribution for an angle $\Theta$, and $\Theta_0$ is an angle formed between an axis of the at least one feed and a line connecting a phase center of the at least one feed and an inner edge of the first annular region.

7. The reflector of claim 6, wherein the at least one feed is a multiple-band antenna.

8. The reflector of claim 6, wherein $\Phi_1$ is equal to 180°.

9. The reflector of claim 6, wherein the feed phase contribution $\phi$ for an angle $\Theta$ is equal to $kd(1-\cos\Theta)$, where k is a circular wavenumber corresponding to a wavelength of the phase front and d is an axial distance between a focal plane of the reflector and a phase center of the at least one feed corresponding to the wavelength of the phase front.

10. The reflector of claim 6, wherein a diameter of the central region is between about 60 inches and about 120 inches.

11. The reflector of claim 6, wherein $w_1$ is between 5% and 15% of a diameter of the central region.

12. The reflector of claim 6, wherein a first discontinuity region disposed between the first annular region and the central region is an abrupt discontinuity region with an annular width $w_d$.

13. The reflector of claim 6, wherein a first discontinuity region disposed between the first annular region and the central region is a smooth discontinuity region with an annular width $w_d$.

14. The reflector of claim 6, wherein a first discontinuity region disposed between the first annular region and the central region has an annular width with an annular width $w_d$ of less than 0.5 inches.

15. The reflector of claim 6, wherein the central region of the reflector has a circular or elliptical shape.

16. The reflector of claim 6, wherein the central region of the reflector has a polygonal shape.

17. The reflector of claim 6, wherein the central region of the reflector has a parabolic curvature.

18. The reflector of claim 6, wherein the central region of the reflector has regions of non-parabolic curvature.

19. The reflector of claim 6, wherein the first annular region of the reflector has a parabolic curvature.

20. The reflector of claim 6, wherein the first annular region of the reflector has regions of non-parabolic curvature.

21. The reflector of claim 6, wherein the reflector further includes a second annular region with an annular width $w_2$, the second annular region axially stepped a height $h_2$ above or below the first annular region and surrounding the first annular region, wherein $h_2$ is approximately equal to $$m_2 \times [\Phi_2 \pm (\phi(\Theta = 0) - \phi(\Theta = \Theta_1))] \times \frac{\pi}{180} \times \frac{\lambda}{2\pi} \times \frac{1}{2},$$

where $m_2$ is a positive odd integer, $\Phi_2$ is a desired amount of phase shift of an outer region of a phase front for reflecting off of the reflector, and $\Theta_1$ is an angle formed between an axis of the at least one feed and a line connecting a phase center of the at least one feed and an outer edge of the first annular region.

22. The reflector of claim 21, wherein a second discontinuity region disposed between the second annular region and the first annular region has an abrupt discontinuity.

23. The reflector of claim 21, wherein a second discontinuity region disposed between the second annular region and the first annular region has a smooth discontinuity.

24. The reflector of claim 21, wherein a second discontinuity region disposed between the second annular region and the first annular region has an annular width less than 0.5 inches.

25. A multiple-beam antenna system, comprising:

a reflector having a central region and a first annular region, the first annular region having an annular width $w_1$ surrounding the central region, the first annular region axially stepped a height $h_1$ above or below the central region; and at least one multiple-band feed for illuminating the reflector, wherein the at least one multiple-band feed is configured for providing transmission and reception of signals over respective transmission and reception frequency bands, and wherein $h_1$ is approximately equal to $$m_1 \times [\Phi_1 \pm (\phi(\Theta = 0) - \phi(\Theta = \Theta_0))] \times \frac{\pi}{180} \times \frac{\lambda}{2\pi} \times \frac{1}{2},$$

where $m_1$ is a positive odd integer, $\Phi_1$ is a desired amount of phase shift of an outer region of a phase front for reflecting off of the reflector, $\phi$ is a feed phase contribution for an angle $\Theta$, and $\Theta_0$ is an angle formed between an axis of the at least one feed and a line connecting a phase center of the at least one feed and an inner edge of the first annular region.

26. The multiple-beam antenna system of claim 25, wherein the at least one multiple-band feed is a multiple-band high efficiency horn antenna.

27. The multiple-beam antenna system of claim 26, wherein the multiple-band high efficiency horn antenna includes a substantially conical wall having an internal surface with a variable slope.

28. The multiple-beam antenna system of claim 25, wherein multiple contoured beams are generated by a single multiple-band feed illuminating the reflector.

* * * * *